United States Patent [19]

Leger

[11] Patent Number: 4,687,889

[45] Date of Patent: Aug. 18, 1987

[54] ELECTRICAL APPLIANCE INTERLOCK SWITCH WITH IMPROVED ISOLATION MEANS

[75] Inventor: Raymond A. Leger, Crystal Lake, Ill.

[73] Assignee: The Cherry Corporation, Waukegan, Ill.

[21] Appl. No.: 512,929

[22] Filed: Jul. 12, 1983

[51] Int. Cl.[4] ..... H01H 3/16

[52] U.S. Cl. ..... 200/61.62; 200/50 A; 200/304; 219/10.55 C

[58] Field of Search ..... 200/50 A, 304; 219/10.55 C

[56] References Cited

U.S. PATENT DOCUMENTS

| | | | |
|---|---|---|---|
| 2,152,780 | 4/1939 | Wheeler | 200/304 |
| 3,742,162 | 6/1973 | Wasemann | 200/61.62 |
| 3,865,097 | 2/1975 | Robinson | 219/10.55 C X |
| 3,924,085 | 12/1975 | Stone | 200/61.62 |
| 3,967,088 | 6/1976 | Horiuchi | 219/10.55 C |
| 4,101,750 | 7/1978 | Doner | 219/10.55 C |
| 4,160,885 | 7/1979 | Ellicott et al. | 200/1 R |
| 4,220,332 | 9/1980 | Ritchie et al. | 339/17 LM |
| 4,233,478 | 11/1980 | Stahl et al. | 200/51.09 |
| 4,303,962 | 12/1981 | Wolber et al. | 361/399 |
| 4,351,995 | 9/1982 | Inoue et al. | 200/159 A |

*Primary Examiner*—A. D. Pellinen
*Assistant Examiner*—Morris Ginsburg
*Attorney, Agent, or Firm*—Willian Brinks Olds Hofer Gilson & Lione Ltd.

[57] ABSTRACT

An interlock switch used with an electrical appliance such as a microwave oven. The interlock switch has a housing in which a plurality of switch elements are mounted. The housing also contains movable and stationary barriers which isolate selected switch elements from others so that broken off pieces from some switch elements will not come in contact with other switch elements.

14 Claims, 6 Drawing Figures

ELECTRICAL APPLIANCE INTERLOCK SWITCH WITH IMPROVED ISOLATION MEANS

BACKGROUND OF THE INVENTION

This invention relates generally to electrical appliances and specifically to microwave ovens which have a frame defining a cooking chamber, and a door hingedly mounted to the frame. More particularly, this invention relates to such appliances which utilize an interlock switch, mounted in the door jamb, actuated by probe means extending from the door in alignment with the door jamb. The interlock switch permits the oven to be operated only when the oven door is fully closed and latched, thereby providing a highly desirable safety feature.

Interlock switches used for this purpose typically comprise two electrically coupled switches, both of which must be actuated in order for operating power to be passed to the oven. The value of such an interlock switch is, of course, reduced if one of the two electrically coupled switches becomes welded closed due to tampering, equipment malfunction or some spurious condition. If this occurs, actuation of the unaffected switch will be the only action necessary to allow operating power to be passed to the oven. This, of course, would defeat many of the safety benefits associated with a conventional interlock switch.

SUMMARY OF THE INVENTION

The present invention contemplates an improved interlock switch for use with an electrical appliance such as a microwave oven. The appliance comprises a frame defining a door jamb, a door mounted to the frame, and a probe mounted to the door in alignment with the door jamb.

The invention further includes an interlock switch housing mounted to the door jamb having actuator means mounted to the housing and being operable by the probe. A first group of conductive switch elements for making a first electrical connection and a second group of conductive switch elements for making a second electrical connection are mounted in the housing. Also mounted in the housing are a stationary barrier and a movable barrier. The stationary barrier is disposed between the first and second groups of conductive switch elements and the movable barrier is disposed substantially linearly with the stationary barrier. The movable barrier is movable from a first position to a second position upon operation of the actuator means by the probe. The stationary and movable barriers isolate the first and second conductive switch elements so that broken off pieces from one of the conductive switch elements cannot come in contact with the other of the conductive switch elements even when the movable barrier is moved from its first position to its second position.

BRIEF DESCRIPTION OF THE DRAWINGS

The preferred embodiment of the invention summarized above is shown in the accompanying drawings wherein.

DETAILED DESCRIPTION OF THE PREFERRED EMBODIMENT OF THE INVENTION

Figure 1:
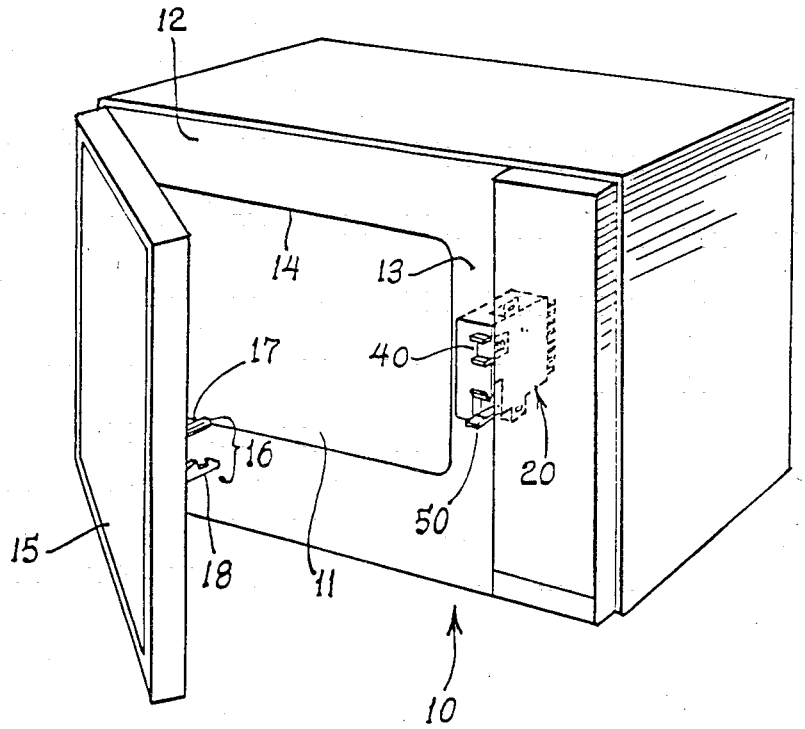
FIG. 1 is a schematic, perspective view of an electrical appliance incorporating the invention.

Referring now to FIG. 1 there is illustrated a preferred embodiment of the invention. In particular, there is illustrated an electrical appliance, such as a microwave oven 10, having a frame 12 defining a chamber 11 into which food to be heated by oven 10 is placed. Frame 12 further includes a door jamb 13 into which is mounted an interlock switch 20.

Oven 10 further includes an oven door 15 which is typically hingebly mounted to frame 12. Near the free end of oven door 15 there is mounted probe means 16, preferably in the form of a rigid pin member 17 and a movable latch pawl 18. Pin member 17 and latch pawl 18 are preferably aligned with door jamb 13, and in particular are aligned, respectively, with a first actuator 40 and a second actuator 50 associated with interlock switch 20. As explained in greater detail hereinafter, pin member 17 operates first actuator 40 as oven door 15 becomes partially closed, and latch pawl 18 operates second actuator 50, when oven door 15 is fully closed and latched.

Figure 5:
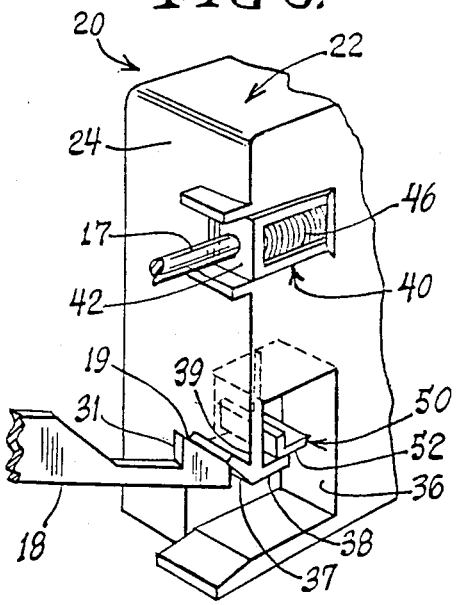
FIG. 5 is an enlarged, schematic, perspective of a portion of the appliance and the interlock switch shown in FIG. 1.
Figure 6:
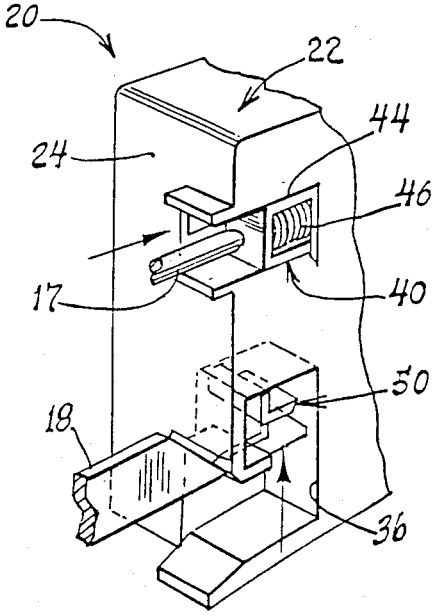
FIG. 6 is an enlarged, schematic, perspective view of the portion of the interlock switch shown in FIG. 5, but in an actuated condition.
Figure 3:
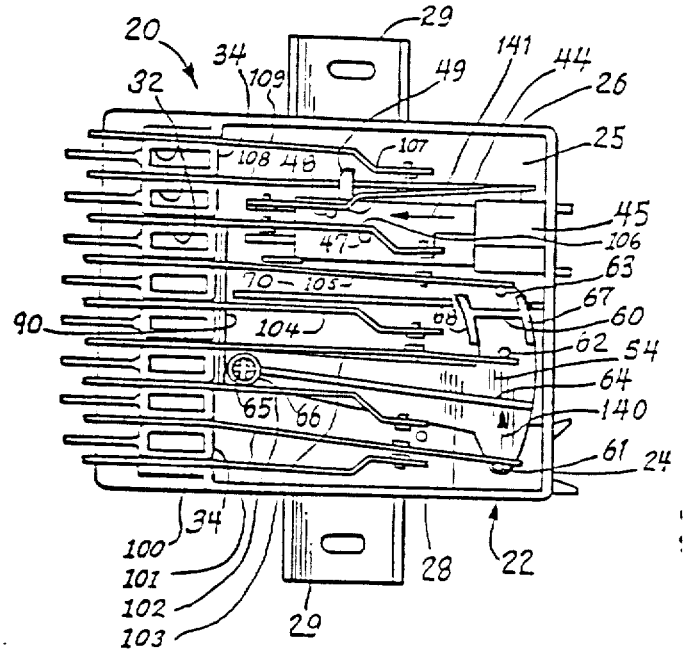
Figure 4:
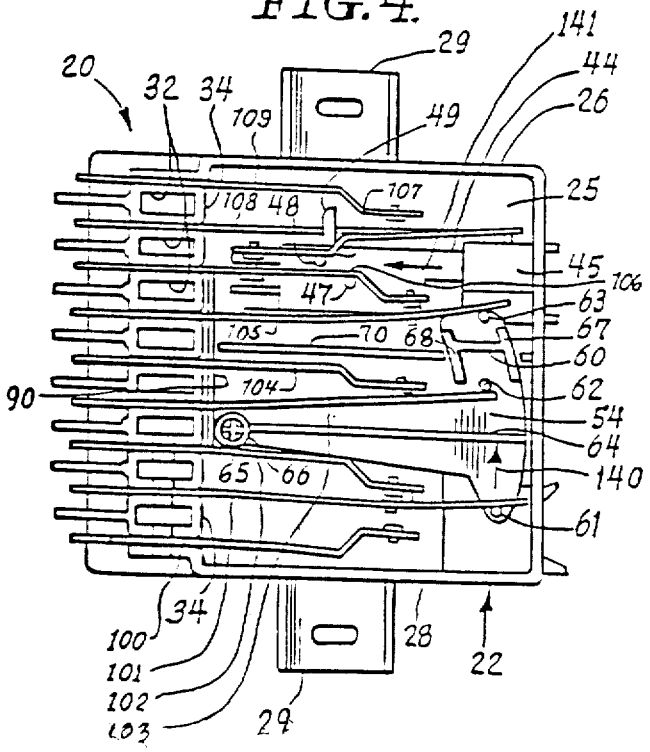

The operation of probe means 16 in the form of pin member 17 and latch pawl 18 are shown best by referring to FIGS. 5 and 6. As oven door 15 closes, rigid pin member 17 abuts a contact face 42 of first actuator 40, thereby moving a slider 44 horizontally (see horizontal arrow in FIG. 6) against a coil spring 46. The movement of slider 44 causes actuation of several switch elements associated with interlock switch 20 in a manner explained in greater detail hereinafter.

Similarly, latch pawl 18 operates second actuator 50 when oven door 15 is fully closed and latched. Thus, still referring to FIGS. 5 and 6, interlock switch 20 comprises a housing 22 having a rear wall 24. Rear wall 24 defines a notch 36 and a latch 39 extending therein. Latch 39 has an angled face 37 and a horizontal face 38 adapted to be sequentially contacted by a latch surface 19 of latch pawl 18. When latch pawl 18 begins to advance into notch 36 in side wall 24, during the closure of oven door 15, latch surface 19 is urged downwardly by angled face 37 of latch 39. As latch pawl 18 advances further into notch 36, latch surface 19 slides along horizontal face 38 of latch 39 until face 38 is aligned with a cutout 31 defined in latch pawl 18. When this occurs, latch pawl 18 springs upwardly (see vertical arrow in Figure 6), whereby oven door 15 is fully closed and latch pawl 18 becomes latched with latch 39.

As shown in FIGS. 5 and 6, in this preferred embodiment, probes 17,18 operate actuators 40,50 without actually entering the interior of housing 22 of interlock switch 20. Indeed, throughout the entire operation of switch 20, actuators 40,50 isolate the outside environment of switch 20 from the interior of housing 22. As a result, door probe wear particles and other spurious material cannot readily enter housing 22 and perhaps interfere with the operation of the various components therein. Further, this arrangement greatly minimizes the likelihood that access to the interior of housing 22 can be gained via an external implement (such as a knife or screwdriver) through tampering, carelessness or accident.

Operation of actuator 50 by the latching of latch pawl 18 to latch 39 causes actuator 50 to move from the position shown in FIG. 5, to the position shown in FIG. 6. This, in turn, causes actuation of several switch elements associated with interlock switch 20 in a manner explained in greater detail hereinafter. From the foregoing description, however, it should be clear that the sequence of movement of actuators 40 and 50 is such that first actuator 40 is operated by rigid pin member 17 before oven door 15 is fully closed, but second actuator 50 is not operated by latch pawl 18 until oven door 15 is fully closed and latched.

Figure 2:
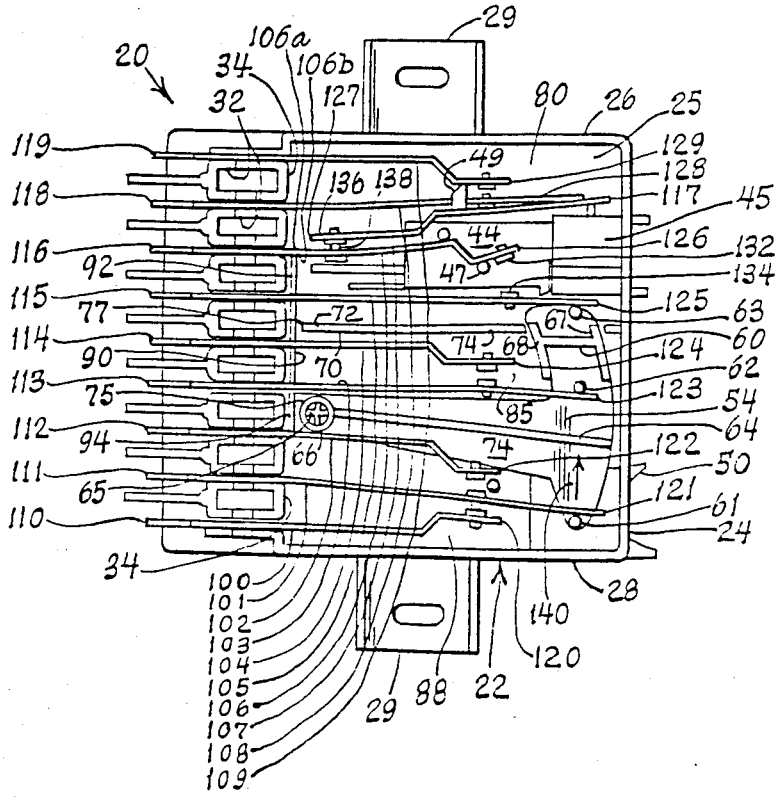
FIG. 2 is a schematic, plan view of the interlock switch used with the appliance shown in FIG. 1.
Figure 3:
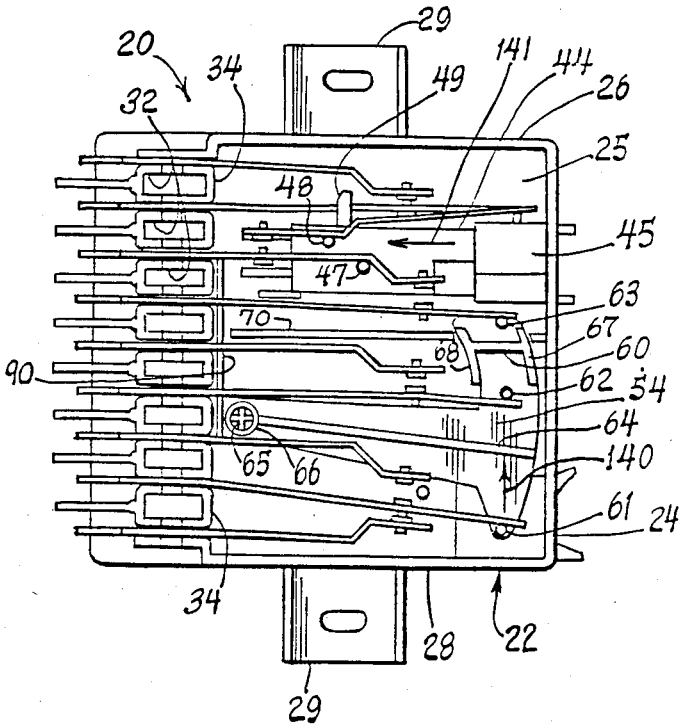
FIG. 3 is a schematic, plan view of the interlock switch shown in FIG. 2 in a partially actuated condition.
Figure 4:
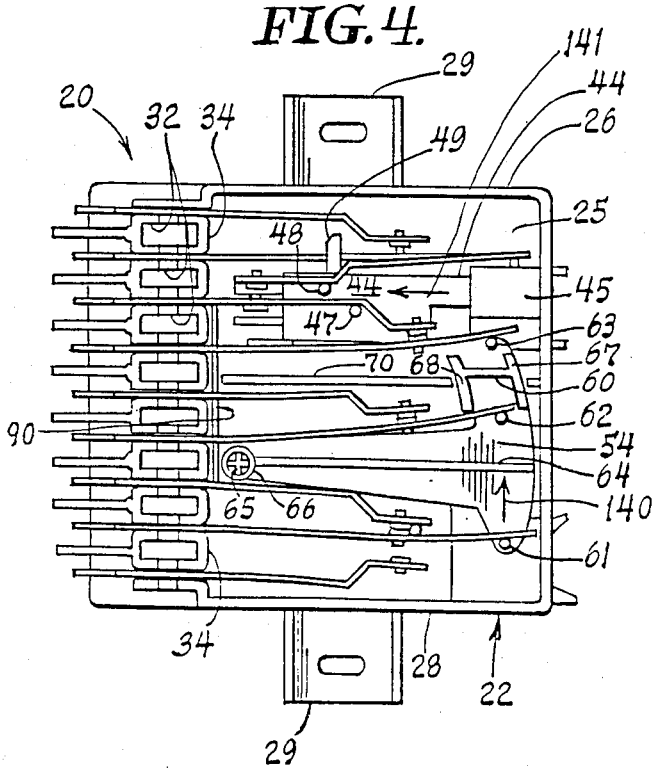
FIG. 4 is a schematic, plan view of the interlock switch shown in FIG. 2 in a fully actuated condition.

The specific components of interlock switch 20 and their operational sequence in response to the movement of actuators 40 and 50 is illustrated in FIGS. 2–4. In particular, FIG. 2 illustrates the position of the switch elements comprising interlock switch 20 when oven door 15 is open, FIG. 3 illustrates the position of those switch elements when oven door 15 is partially closed, and FIG. 4 illustrates the position of those switch elements when oven door 15 is fully closed and latched.

Referring now to FIG. 2, housing 22 of interlock switch 20 is shown to include, in addition to rear wall 24, a pair of side walls 26, 28 a bottom wall 25, and a plurality of anchoring fixtures 32 defining an interior front wall 34. Extending outwardly from side walls 26, 28 are a pair of mounting ears 29 which are used to facilitate the mounting of interlock switch 20 in door jamb 13 of oven 10.

Interlock switch 20 further includes a stationary barrier 70 which preferably comprises a rigid member extending upwardly from base 25 near the center of housing 22. Pivotally mounted to base 25 of housing 22 is a platform 54 having a movable barrier 60 extending upwardly therefrom along substantially the same line defined by stationary barrier 70 when oven door 15 is in the fully closed position of FIG. 4. A pair of substantially parallel flange members 67, 68 also extend upwardly from platform 54 intersecting, respectively, the opposite ends of movable barrier 60. Also extending upwardly from platform 54 are three rigid pins 61, 62 and 63 whose function will be explained hereinafter.

An additional moveable barrier 64, extending substantially parallel to stationary barrier 70 when oven door 15 is in the fully closed position of FIG. 4 also extends upwardly from platform 54. Additional barrier 64 terminates in a hub 66 which is mounted over a post 65 extending upwardly from base 25. Actuator 50 is preferably integrally formed with platform 54 near the end thereof opposite hub 66. Thus, movement of actuator 50, in response to movement of latch pawl 18, causes platform 54 to pivot about post 65. This movement of platform 54 causes a corresponding movement of pins 61, 62 and 63, movable barrier 60, and additional barrier 64.

Housing 22 further incorporates a slider guide 45 through which slider 44 can be moved back and forth in response to the operation of actuator 40 by rigid pin member 17. Extending upwardly from slider 44 is a pair of actuator pins 47, 48, and extending transversely from slider 44 is an actuator arm 49. The functions of actuator pins 47, 48 and actuator arm 49 will be explained hereinafter.

Mounted inside housing 22 of interlock switch 20 are a plurality of electrically conductive switch elements 100–109. Switch elements 100–106 and switch elements 108–109 have, respectively, fixed ends 110–116 and 118–119, substantially captivated between adjacent ones of anchoring fixtures 32, and (except for switch element 108) free ends 120–126 and 128–129.

Interlock switch 20 also includes an electrically conductive switch element 107 which is preferably integrally formed with switch element 108. Thus, in this embodiment, switch element 107 has a free end 127 and an interconnected end 117 which connects with an interconnected end 128 of switch element 108. Each of switch elements 100–109 is preferably mounted edgewise within housing 22 of interlock switch 20, so that they may function as leaf springs, and are formed of electrically conductive material such as copper or the like.

In this preferred embodiment switch elements 100 and 101 form part of a circuit for an auxillary device such as a lamp (not shown), and are normally closed, i.e., in the "make" condition, when oven door 15 is in the open position of FIG. 2. Thus, the lamp in the circuit comprising switch elements 100 and 101 will be illuminated when oven door 15 is open.

Switch elements 101 and 102 preferably form part of a primary interlock circuit for microwave oven 10, and are normally open, i.e., in the "break" condition when oven door 15 is in the open position of FIG. 2. Thus, switch elements 101 and 102 prevent operating power from being supplied to microwave oven 10 as long as oven door 15 is open, converting to the "make" condition only when the door is fully closed and latched.

Switch elements 103 and 104 preferably form part of a logic circuit (not shown) which, in accordance with well known microwave oven operation, controls many of the oven's operating parameters and sequences. As shown in FIG. 2, switch elements 103 and 104 are normally in the "break" condition when oven door 15 is open, thereby rendering the logic circuitry inoperative at that time.

Switch elements 105 and 106 comprise the secondary interlock for microwave oven 10. As with the primary interlock defined by switch elements 101 and 102, switch elements 105 and 106 are normally in the "break" condition when oven door 15 is open, changing to the "make" condition only when oven door 15 is fully closed and latched.

Switch elements 106 and 107 form part of a monitoring circuit which includes a fuse (not shown), and are normally in the "make" condition when the oven door is open. In accordance with conventional interlock switch operation, if switch elements 106 and 107, and switch elements 105 and 106, are ever simultaneously closed, such as if a malfunction causes switch elements 105 and 106 to be welded together, the fuse will blow, thereby preventing operating power from being supplied to oven 10 even if all other conditions for proper oven operation have been satisfied. Switch element 106, sometimes referred to herein as a common switch element, has a monitor side **106*a* and an interlock side 106*b*. A part 138 of switch element 106 on the monitor side 106*a* is adapted to contact a portion 136 of switch element 107 near the free end 127 thereof when oven door 15 is open. On the other hand, a part 132 on the interlock side 106***b* of switch element 106 is adapted to contact a portion 134 of switch element 105 when oven door 15 is fully closed and latched.

Finally, switch elements 108 and 109, which are normally in the "break" condition when oven door 15 is open, form part of a second auxillary circuit which may also include a lamp (not shown). In this preferred embodiment switch elements 108 and 109 are disposed lower in housing 22 than any of the other switch elements 100 through 107. In particular, switch elements 108 and 109 are located in a plane slightly above base 25 of housing 22, while switch elements 100 through 107 are located in a plane closer to the top of housing 22.

A buss 90, preferably comprised of an integrally formed segment 94 of switch element 102 and an integrally formed segment 92 of switch element 106 serves to electrically interconnect those two switch elements. For safety purposes, buss 90 is mounted edgewise in gaps 75 and 77, thereby being substantially captivated between interior front wall 34 on the one hand, and the forward end 72 of stationary barrier 70 and the forward end of movable barrier 64, i.e., hub 66 on the other hand. The segments 92, 94 comprising buss 90 are preferably formed by bending portions of switch elements 102 and 106 until the ends of the bent portions are in facing relationship. These ends of segments 92, 94 are then electrically interconnected in any conventional manner.

Stationary barrier 70 and movable barrier 60, along with portions of rear wall 24, side wall 26 and interior front wall 34, define a first compartment 80 within housing 22 of interlock switch 20. First compartment 80 serves to confine, within that compartment, any pieces of interlock switch 20 which, due to part failure, abuse, or manufacturing error, become broken off and loose inside housing 22. By isolating such broken off pieces in this manner, they cannot accidentally fall into a portion of housing 22 outside the boundaries of first compartment 80 and accidentally short circuit or interfere with other switch elements or components. For the same purpose, stationary barrier 70, movable barrier 60 and additional barrier 64, along with portions of rear wall 24 and interior front wall 34 define a second compartment 85, isolated from other portions of housing 22. Similarly, additional barrier 64, along with portions of rear wall 24, side wall 28 and interior front wall 34 define a third compartment 88, isolated from other portions of housing 22.

The operation of interlock switch 20 can now be explained. When oven door 15 is open, the switch elements of interlock switch 20 take the configuration shown in FIG. 2. In this configuration, pin 61 provides a force on switch element 101 substantially in the direction of arrow 140. Similarly, pin 63 provides a force on switch element 105 substantially in the same direction as arrow 140. On the other hand, pin 62 provides a force on switch element 103 in the direction opposite arrow 140. Thus, when actuator 50 is operated by latch pawl 18 (FIG. 6) the force opposing the movement of actuator 50 is substantially reduced. In particular, if the magnitude of the force at each of pins 61, 62 and 63 is substantially equal, the combined force of pins 61, 62 and 63 opposing movement of actuator 50 is approximately one third that which it would be if the forces applied by all three pins 61, 62 and 63 were in the same direction as arrow 140.

As oven door 15 begins to close, the operation of rigid pin member 17 and actuator 40 takes effect. This, in turn, causes slider 44, and hence actuator pins 47, 48 and actuator arm 49, to move from the positions shown in FIG. 2 to the position shown in Figure 3. Thus, switch elements 108 and 109 move from the "break" to the "make" position while switch elements I07 and I06 move from the "make" to the "break" position. Further, switch element 106 moves closer to (but still does not contact) switch element 105.

When oven door 15 is fully closed, and latch pawl 18 is latched to latch 39 (FIG. 6), the switch elements change from the positions shown in FIG. 3 to the positions shown in FIG. 4. More particularly, switch elements 105 and 106 contact one another. Switch elements 103 and 104 move from the "break" to the "make" position, switch elements 101 and 102 move from the "break" to the "make" position, and switch elements 100 and 101 move from the "make" to the "break" position.

The interlock switch described herein, when used in connection with an electrical appliance such as microwave oven 10, provides many efficiencies, economies, and safety features. For example, the use of switch element 106 as a cantilevered common switch element adapted to contact switch element 107 on one side of switch element 106 and to contact switch element 105 on the other side of switch element 106, combines the advantages of reliability, efficiency, economy, and compactness in a single switch. Further, the use of stationary and movable barriers of the type described isolates any pieces of interlock switch 20 which, due to part failure, abuse, or manufacturing error, become broken off or loose inside housing 22. As such, these broken off pieces cannot accidentally fall into portions of housing 22 outside the boundaries of the compartments in which they are confined, and accidentally short circuit or interfere with other switch elements or components. Additionally, by captivating buss 90 in gaps 75 and 77, and forming it integrally from portions of switch elements 102 and 106, the chances of buss 90 breaking away and causing electrical or mechanical damage to the other components of interlock switch 20 is greatly reduced.

In view of the foregoing, the above described interlock switch, adapted for use with an electrical appliance such as a microwave oven, has numerous benefits and advantages not available heretofore. However, several modifications and embodiments of this switch, and its operating environment, which do not part from the true scope of the invention, will become apparent to those skilled in the art. Accordingly, all such modifications and embodiments are intended to be covered by the appended claims.

I claim:

1. An interlock switch comprising:

a housing;

actuator means mounted to said housing for movement in response to an actuating force;

a plurality of conductive switch elements arranged in a first group and mounted in said housing for making a first electrical connection in response to movement of said actuator means;

a plurality of conductive switch elements arranged in a second group and mounted in said housing for making a second electrical connection in response to movement of said actuator means;

stationary insulating barrier means, mounted in said housing between said first and second group of conductive switch elements;

movable insulating barrier means, disposed within said housing, movable from a first position to a second position with movement of said actuator means to maintain electrical isolation between said first and second group of conductive switch elements as said actuator means moves;

a first compartment defined, at least in part, by portions of said stationary and movable insulating barrier means, said first compartment bounding said first group of conductive switch elements; and a second compartment defined, at least in part, by portions of said stationary and movable insulating barrier means, said second compartment bounding said second group of conductive switch elements, whereby said first and second groups of conductive switch elements remain bounded even upon movement of said movable insulating barrier means from said first position to said second position.

2. The interlock switch defined in claim 1 further including:

platform means, movable by said actuator means; and additional insulating barrier means extending upwardly from said platform means to define, at least in part, an additional compartment for additional conductive switch elements.

3. An interlock switch for operating an electrical appliance in response to opening and closing of a door of the appliance, the interlock switch comprising:

a housing;

first and second conductive switch elements mounted in said housing;

stationary insulating barrier means disposed within said housing between said first and second conductive switch elements and forming a contiguous isolation structure; and movable insulating barrier means disposed within said housing between said first and second conductive switch elements, movable from a first position to a second position upon closure of said door when said interlock switch is mounted on the appliance to maintain electrical isolation between said first and second conductive switch elements even as said door opens or closes;

said stationary and movable insulating barrier means defining, at least in part, substantially closed first and second compartments when said movable insulating barrier means are in either said first or second positions, whereby pieces broken from one of said conductive switch elements cannot come in contact with the other of said conductive switch elemnts.

4. An interlock switch for operating an electtical appliance in response to opening and closing of a door of the appliance, the interlock switch comprising:

a housing;

first and second conductive switch elements mounted in said housing;

a stationary insulating barrier means and a movable insulating barrier means, for isolating said first and second conductive switch elements so that pieces broken from one of said conductive switch elements cannot come in contact with the other of said conductive switch elements;

means for moving said movable insulating barrier means while maintaining the isolation between said first and second conductive switch elements;

a third conductive switch element; and additional insulating barrier means for isolating said third conductive switch element form at least one of said first and second conductive switch elements.

5.The inerlock switch defined in claim 4 further including:

a base forming part of said housing;

actuator means for moving in response to the opening and closing of the door of said appliance;

platform means mounted on said base and movable by said actuator means; and said additional insulating barrier means being mounted on said platform means.

6. The interloc switch defined in claim: 4 wherein said housing further includes an interior wall, a gap formed between said interior wall, and the ends of said stationary and said additional insulating barrier means, and an electrically conducting buss disposed in said gap substantially perpendicular to said stationary and said additional insulating barrier means, said electrically conducting buss for conductively connecting said third conductive switch element and said first conductive switch element across said stationary and said additional insulating barrier means without impairing the electrical isolation maintained between said first, second, and third conductive switch elements by said stationary, movable, and additional insulating barrier means.

7. The interlock switch defined in claim 6 wherein said electrically conducting buss is integrally formed with at least one of said first and third conductive switch elements.

8. An interlock switching system, comprising:

an electrical appliance including a door for opening and closing and probe means supported on said door for movement with the door;

an interlock switch mounted on said appliance for engaging said probe means when said door is closed and disengaging said probe means when the door is opened to operate the appliance, said interlock switch including:

a housing mounted to said appliance;

actuator means mounted to said housing for moving when engaged and disnegaged by said probe means; and first, second and third electrically conductive switch elements mounted in said housing;

means, including a stationary insulating barrier and a movable barrier for electrically isolating said first and second conductive switch elements so that pieces broken off from one of said conductive elements cannot come in contact with the otehr of said conductive switch elements;

said actuator means, responsive to said probe means, for moving said movable insulating barrier to maintain the electrical isolation between said first and second conductive switch elements even as said door opens or closes and said probe means engages or disengages said actuator means;

platform means movable by said actuator means; and additional insulating barrier means, extending upwardly from said platform means for electrically isolating said third conductive switch element from at least one of said first and second conductive switch elements.

9. The interlock switch defined in claim 8 wherein said interlock switch housing further includes an interior wall, a gap formed between said interior wall and the ends of said stationary and said additional barrier means, and an electrically conducting buss disposed in said gap substantially perpendicular to said stationary and said additional barrier means, said electrically conducting buss for conductively connecting said third conductive switch element and said first conductive switch element across said stationary and said additional barrier means without impairing the electrical isolation maintained between said first, second, and third conductive switch elements by said stationary, movable, and additional barrier means.

10. The interlock switch defined in claim 9 wherein said electrically conducting buss is integrally formed with at least one of said first and third conductive switch elements.

11. An interlock switch for operating an electrical appliance in response to opening and closing of a door of the applinace, said inetrlock switch comprising:

a housing for mounting to said appliance;

first, second, and third conductive switch elements mounted in said housing;

a stationary and a movable insulating barrier, each disposed within said housing between said first and second conductive switch elements to electrically isolate said first and second conductive switch elements so that broken pieces from one of said conductive switch elements cannot come in contact with the other of said conductive switch elements;

actuator means mounted on said housing for moving said movable barrier in response to opening and closing of said door to maintain the electrical isolation between said first and second conductive switch elements as said door opens and closes;

platform means movable by said actuator means in response to opening and closing of said door;

a third conductive switch element;

additional insulating barrier means, extending upwardly from said platform means for electrically isolating said third conductive switch element from at least one of said first and second conductive switch elements;

an interior wall formed within said housing;

a gap formed between said interior wall and the ends of said stationary and said additional barrier means; and an electrically conducting buss disposed in said gap substantially perpendicular to said stationary and said additional barrier means for electrically connecting said third conductive switch element and said first conductive switch element across said stationary, movable and additional barrier means without impairing the electrical isolation formed between said first, second, and third conductive switch elements by said stationary, movable, and additional barrier means.

12. The interlock switch defined in claim 11 wherein said electrically conducting buss is integrally formed with at least one of said first and third conductive switch elements.

13. An interlock switch, comprising barrier means for defining at least two electrically isolated compartments;

at least one electrically conductive switching element in each one of said compartments for moving to define switch states; and actuating means for moving within said at least two compartments to engage and move at least one of said electrically conductive elements in each of said compartments;

said barrier means comprising a contiguous stationary wall portion and a movable wall portion for moving with said actuating means adjacent to said stationary wall portion to maintain electrical isolation between said at least two compartments.

14. An interlock switch for operating an electrical appliance in response to opening and closing of a door of the appliance, the interlock switch comprising:

a housing;

first and second conductive switch elements mounted in said housing;

a stationary insulating barrier means comprising a contiguous isolation structure and a movable insulating barrier means for isolating said first and second conductive switch elements so that pieces broken from one of said conductive switch elements cannot come in contact with the other of said conductive switch elements; and means for moving said movable insulating barrier means while maintaining the isolation between said first and second conductive switch elements.

* * * * *

UNITED STATES PATENT AND TRADEMARK OFFICE

CERTIFICATE OF CORRECTION

PATENT NO. : 4,687,889

DATED : August 18, 1987

INVENTOR(S) : Raymond A. Leger

It is certified that error appears in the above-identified patent and that said Letters Patent is hereby corrected as shown below:

Replace FIGS. 3 and 4 with the correct FIGS. 3 and 4 attached hereto.

Signed and Sealed this

Fourth Day of October, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,687,889

DATED : August 18, 1987

INVENTOR(S) : Raymond A. Leger

It is certified that error appears in the above-identified patent and that said Letters Patent is hereby corrected as shown below:

Col. 6, line 5, delete "I07" and insert therefor --107--;

Col. 6, line 5, delete "I06" and insert therefor --106--;

Col. 7, line 52, delete "elemnts" and insert therefor --elements--;

Col. 7, line 53, delete "electtical" and insert therefor --electrical--;

Col. 8, line 2, delete "form" and insert therefor --from--;

Col. 8, line 5, delete "inerlock" and insert therefor --interlock--;

Col. 8, line 14, delete "interloc" and insert therefor -- interlock--;

Col. 8, line 14, delete ":";

Col. 8, line 16, delete ",";

Col. 8, line 37, following "switch" insert --having a housing--;

Col. 8, line 42, delete "a housing mounted to said appliance;";

UNITED STATES PATENT AND TRADEMARK OFFICE

CERTIFICATE OF CORRECTION

PATENT NO. : 4,687,889

DATED : August 18, 1987

INVENTOR(S) : Raymond A. Leger

It is certified that error appears in the above-identified patent and that said Letters Patent is hereby corrected as shown below:

Col. 8, line 44, delete "disnegaged" and insert therefor --disengaged--;

Col. 8, line 48, delete "means, including";

Col. 8, line 48, following "barrier" insert --means--;

Col. 8, line 49, following "movable" insert --insulating-- and following "barrier" insert --means--;

Col. 8, line 51, following "conductive" insert --switch--;

Col. 8, line 52, delete "otehr" and insert therefor --other--;

Col. 8, line 55, following "barrier" insert --means--;

Col. 9, line 18, delete "applinance" and insert therefor --appliance--;

Col. 9, line 18, delete "inetrlock" and insert therefor --interlock--;

Col. 9, line 22, following "barrier" insert --means--;

Col. 9, line 31, following "barrier" insert --means--;

Col. 9, line 36, following "door" insert --when said interlock switch is mounted on the appliance--; and